United States Patent [19]

Hata

[11] Patent Number: 4,891,158

[45] Date of Patent: Jan. 2, 1990

[54] OXIDE SEMICONDUCTOR FOR THERMISTOR AND MANUFACTURING METHOD THEREOF

[75] Inventor: Takuoki Hata, Neyagawa, Japan

[73] Assignee: Matsushita Electric Industrial Co., Ltd., Kadoma, Japan

[21] Appl. No.: 902,445

[22] PCT Filed: Nov. 6, 1985

[86] PCT No.: PCT/JP85/00616

§ 371 Date: Jul. 8, 1986

§ 102(e) Date: Jul. 8, 1986

[87] PCT Pub. No.: WO86/03051

PCT Pub. Date: May 22, 1986

[30] Foreign Application Priority Data

| | | | |
|---|---|---|---|
| Nov. 8, 1984 | [JP] | Japan | 59-235711 |
| Nov. 8, 1984 | [JP] | Japan | 59-235708 |
| Nov. 8, 1984 | [JP] | Japan | 59-235716 |
| Nov. 20, 1984 | [JP] | Japan | 59-245099 |
| Jan. 21, 1985 | [JP] | Japan | 60-7351 |
| Jan. 21, 1985 | [JP] | Japan | 60-7352 |

[51] Int. Cl.[4] ..... H01B 1/06

[52] U.S. Cl. ..... 252/518; 252/519; 252/520; 252/521; 252/512

[58] Field of Search ..... 338/22 R; 323/364; 252/518, 519, 520, 521, 512

[56] References Cited

U.S. PATENT DOCUMENTS 4,729,852 3/1988 Hata ..... 252/519

FOREIGN PATENT DOCUMENTS

| | | |
|---|---|---|
| 1090790 | 10/1960 | Fed. Rep. of Germany . |
| 2234639 | 1/1975 | France . |
| 55-88305 | 7/1980 | Japan . |
| 0028510 | 5/1981 | Japan . |
| 57-184206 | 11/1982 | Japan . |
| 60-22302 | 2/1985 | Japan . |
| 874882 | 8/1961 | United Kingdom . |

OTHER PUBLICATIONS

Review of Scientific Instruments, vol. 40, No. 4, Apr. 1969, pp. 544–549, by E. G. Wolff.

*Primary Examiner*—Josephine Barr

*Attorney, Agent, or Firm*—Cushman, Darby & Cushman

[57] ABSTRACT

The present invention relates to oxide semiconductors for thermistors for use as sensors mainly in a temperature range of 200°–500°, an embodiment of which comprises 5 kinds of metal elements 60.0–98.5 atomic % of Mn, 0.1–5.0 atomic % of Ni, 0.3–5.0 atomic % of Cr, 0.2–5.0 atomic % of Y and 0.5–28.0 atomic % of Zr, to the sum total of 100 atomic %; the oxide semiconductors for thermistors have an excellent characteristic feature as temperature sensors for use in intermediate and high temperature ranges; that is, giving such a small resistance change with time as within ±5% at temperatures between 200°–500° C., they are most suitable for temperature measurement applications where high reliability is required at high temperatures.

20 Claims, 5 Drawing Sheets

OXIDE SEMICONDUCTOR FOR THERMISTOR AND MANUFACTURING METHOD THEREOF

TECHNICAL FIELD

The present invention relates to a oxide semiconductors for thermistors adapted for use mainly in a temperature range of 200°–500° C.

BACKGROUND ART

Heretofore, thermistors comprising oxides of Mn and Co as their main components have been widely used. They include compositions of Mn-Co system oxide, Mn-Co-Cu system oxide, Mn-Co-Ni system oxide and Mn-Co-Ni-Cu system oxide, which have been used as general purpose disc shape thermistors for such applications as in temperature compensation, etc. These thermistors give, as a characteristic of such materials, specific resistances from ten and several Ω-cm to one hundred and several tens kΩ-cm for use mainly in a temperature range from −40° C. to 150° C. However, demand for their use as temperature sensors has recently grown larger; thus, thermistor sensors which are usable at higher temperatures have been in demand.

As a first step, a demand has been raised for thermistor sensors which are usable at temperatures up to 300° C. for temperature control of petroleum combustion equipment. In order to deal with this situation, materials with high specific resistances have been used as materials of thermistors in the place of conventional materials comprising oxides of Co-Mn as their main components and until now Mn-Ni-Al system oxide semiconductors (Japanese Patent Gazette Patent Laid-Open No. Sho 57-95603) and Mn-Ni-Cr-Zr system oxide semiconductors (Specification of U.S. Pat. No. 4,324,702) offered by the present inventors have been put into practical use.

With regard to the construction of the sensor, sloughing conventional structure of the disc shape thermistor molded of resin, the object of shielding it from high temperature atmosphere has been attained by sealing a thermistor element of such a very minute size as 500 μm×500 μm×300 μm (t) in a glass tube or by coating glass on the thermistor element by way of dipping. On the other hand, just as the disc shape thermistors, bead shape thermistors have been improved in heat resistance by glass-coating.

However, a demand for thermistor sensors which are usable at still higher temperatures has not been abated, there is a strong demand for sensors at such temperatures as above 300° C., 500° C. or up to 700° C. These demands can not be met with the conventional materials because of the following two problems involved: (1) their specific resistances, one of characteristics of thermistor materials, are low; that is, resistances required for operation of equipment at intended temperatures can not be obtained, and (2) they are not reliable because their resistance changes with time at high temperatures and thus exceeds the required 5% (500° C., 1000 Hr).

On the other hand, materials used at such high temperatures as 700° C.–1000° C., stabilized zirconia ($ZrO_2$-$Y_2O_3$, $ZrO_2$-CaO, etc.), Mg-Al-Cr-Fe system oxide compositions, etc., have been developed. However, as these oxide materials require such high sintering temperatures above 1600° C.; they could not be sintered, using ordinary electric furnaces (operatable at 1600° C. max.). Moreover, even sintered materials give large resistance changes with time at high temperatures, being as large as 10% (1000 Hr) as reported for even the very stable ones, and therefore, improvement in reliability is further sought.

To solve this problem, new materials have already been developed in Japan, but they are still in the evaluation stage (Mn-Zr-Ni system oxide: Japanese Patent Gazette, Patent Laid-Open No. Sho 55-88305 ($Ni_xMg_yZn_z$) $Mn_2O_4$-spinel type: ibid. Patent Laid-Open No. Sho 57-88701 ($Ni_pCo_qFe_rAl_sMn_t$)$O_4$-spinel type: ibid. Patent Laid-Open No. Sho 57-88702).

SUMMARY OF THE INVENTION

The present invention provides oxide semiconductors for thermistors comprising 5 kinds of metal elements -60.0–98.5 atomic % of manganese (Mn), 0.1–5.0 atomic % of nickel (Ni), 0.3–5.0 atomic % of chromium (Cr), 0.2–5.0 atomic % of yttrium 0.5–28.0 atomic % of zirconium (zr), to a sum total of 100 atomic %—which endow the thermistors with a high reliability as evidenced by their resistance changes with time after a lapse of 1000 hr at 500° C. being within ±5%.

THE BEST MODE FOR EMBODYING THE INVENTION

Figure 1:
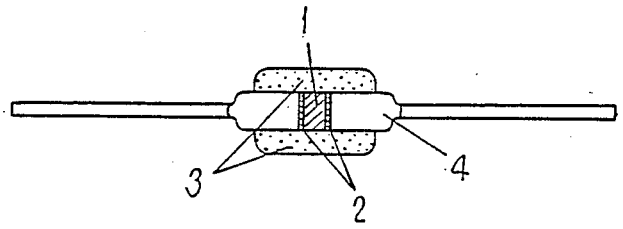
FIG. 1 is a front view of section of a thermistor sealed in glass which has been trial-made from the composition of the present invention.

The present invention is the accumulated result of various experiments providing oxide semiconductors for a thermistor comprising 5 kinds of metal elements—60.0–98.5 atomic % of manganese (Mn), 0.1–5.0 atomic % of nickel (Ni), 0.3–5.0 atomic % of chromium (Cr), 0.2–5.0 atomic % of yttrium (Y) and 0.5–28.0 atomic % of zirconium (Zr), to the sum total of 100 atomic %.

Also it provides other oxide semiconductors for a thermistor further comprising 2.0 atomic % or below of silicon (Si) (exclusive of 0 atomic %) in addition to the composition comprising 5 kinds of metal elements—60-.0–98.5 atomic % of manganese (Mn), 0.1–5.0 atomic % of nickel (Ni), 0.3–5.0 atomic % of chromium (Cr), 0.2–5.0 atomic % of yttrium and 0.5–28.0 atomic % of zirconium (Zr), to the sum total of 100 atomic %.

In the following, this invention is described in connection with some embodiments thereof:

<EXAMPLE 1>

First, $MnCO_3$, NiO and $Cr_2O_3$, materials available on the market, and $ZrO_2$ having $Y_2O_3$ dissolved therein in solid state were so proportioned as to have the composition of respective atomic % shown in Table 1 below. The materials were mixed together in the wet state in a ball-mill and, thereafter, dried and calcined at 1000° C. The product was again milled with a ball-mill and the slurry obtained was dried. After drying and adding polyvinyl alcohol and mixed therewith as a binder, a required amount of the slurry, was taken and pressed into a block 30 mm in diameter and 15 mm thick. The pressed block was sintered in air at 1500° C. for 2 hr. The block obtained in this way was sliced and ground to produce a 150–400 μm thick wafer therefrom and a platinum electrode was provided on this wafer by screen printing method. A chip of the desired size was cut from this wafer provided with the electrode. This element was sealed in a glass tube in an atmosphere of argon gas, hermetically sealed from ambient air. At this time, Dumet wire was utilized as the lead wire terminal, but slag leads such as Kovar wire, etc., may be employed to suit the operating temperature. Depending on the type of slag lead, the sealed-in atmosphere may be altered, as appropriate, into air, etc.. The resistance change of this thermistor sealed in glass was measured after leaving for 1000 hr in air at 500° C. Its specific resistances at 25° C. are shown, as the initial characteristic, together with the thermistor constant as a thermistor sealed in glass, in listed in Table 1. The thermistor constant B was calculated by the following formula (1) from the resistance values obtained by measurements at two temperatures of 300° C. and 500° C. The element dimensions were 400 μm×400 μm×300 μm.

$$B = 2.215 \times 10^3 \ln \frac{R300^\circ\ C.}{R500^\circ\ C.} . \quad (1)$$

TABLE 1

| Sample No. | Sample composition (atom %) Mn | Ni | Cr | Y | Zr | Si | $\rho_{25^\circ C.}$ (Ω · cm) | B (300° C. / 500° C.) (K) | Rate of resistance change with time (%) |
|---|---|---|---|---|---|---|---|---|---|
| 101 | 69.5 | 5.0 | 5.0 | 0.5 | 20.0 | 0 | 365K | 5670 | 4.4 |
| *102 | 69.0 | 5.5 | 5.0 | 0.5 | 20.0 | 0 | 290K | 5510 | 5.8 |
| *103 | 72.0 | 2.0 | 5.5 | 0.5 | 20.0 | 0 | 510K | 5820 | 5.1 |
| 104 | 76.0 | 2.0 | 2.0 | 0.6 | 19.4 | 0 | 720K | 6030 | 2.4 |
| 105 | 68.0 | 2.5 | 2.5 | 2.0 | 25.0 | 0 | 680K | 5940 | 2.8 |
| *106 | 64.0 | 1.0 | 4.0 | 1.0 | 30.0 | 0 | 840K | 6400 | 5.5 |
| *107 | 64.5 | 2.5 | 2.5 | 5.5 | 25.0 | 0 | 740K | 6230 | 5.8 |
| *108 | 75.0 | 5.0 | 5.0 | 0 | 15.0 | 0 | 190K | 5410 | 10.3 |
| *109 | 82.4 | 0 | 2.3 | 0.3 | 15.0 | 0 | 1.3 M | 6740 | 7.2 |
| *110 | 82.4 | 2.3 | 0 | 0.3 | 15.0 | 0 | 290K | 5600 | 6.3 |
| *111 | 98.6 | 0.4 | 0.3 | 0.2 | 0.5 | 0 | 970K | 6350 | 5.8 |
| *112 | 59.0 | 3.5 | 4.5 | 5.0 | 28.0 | 0 | 795K | 6280 | 5.2 |
| *113 | 94.6 | 2.5 | 2.5 | 0.2 | 0.2 | 0 | 287K | 5480 | 5.3 |
| 114 | 62.0 | 2.0 | 5.0 | 3.0 | 28.0 | 0 | 810K | 6500 | 3.6 |
| 115 | 79.7 | 2.0 | 2.0 | 1.3 | 15.0 | 0 | 485K | 5990 | 3.9 |
| 116 | 80.3 | 2.0 | 2.0 | 0.7 | 15.0 | 0 | 513K | 6020 | 2.6 |
| 117 | 74.8 | 2.0 | 2.0 | 1.2 | 20.0 | 0 | 550K | 6210 | 3.3 |
| 118 | 74.8 | 2.0 | 2.0 | 1.2 | 20.0 | 0.5 | 738K | 6370 | 3.4 |
| 119 | 74.8 | 2.0 | 2.0 | 1.2 | 20.0 | 1.0 | 989K | 6610 | 3.7 |
| 120 | 74.8 | 2.0 | 2.0 | 1.2 | 20.0 | 2.0 | 2.3 M | 7030 | 5.0 |
| *121 | 74.8 | 2.0 | 2.0 | 1.2 | 20.0 | 2.5 | 4.8 M | 8040 | 14.3 |
| 122 | 85.0 | 1.6 | 3.0 | 0.4 | 10.0 | 0.3 | 394K | 5680 | 4.8 |
| 123 | 80.8 | 1.0 | 2.5 | 0.7 | 15.0 | 1.0 | 845K | 6490 | 3.7 |
| 124 | 79.3 | 1.0 | 4.0 | 0.7 | 15.0 | 0.5 | 711K | 6130 | 4.3 |
| 125 | 80.3 | 1.5 | 2.5 | 0.7 | 15.0 | 0 | 480K | 5750 | 4.0 |
| 126 | 69.0 | 1.5 | 2.5 | 2.0 | 25.0 | 0 | 678K | 6000 | 2.9 |
| 127 | 68.0 | 1.5 | 2.5 | 3.0 | 25.0 | 0 | 634K | 5960 | 2.8 |
| 128 | 90.0 | 0.3 | 4.5 | 0.2 | 5.0 | 0 | 540K | 5810 | 4.8 |

(The mark * identifies comparison sample.)

Table 1 clearly shows that products of Sample Nos. 108, 109 and 110 are comparison samples of 4 component system and Sample Nos. 102, 103, 106, 107, 111, 112, 113 and 121 are also comparison samples; all of them were found lacking in stability in practical use, giving rates of resistance change with time at 500° C. in excess of 5%.

As hereabove described, the samples used for measuring the rates of resistance change with time were sintered after being molded by dry pressing, but bead type elements may be used; thus, this invention is not bound by the element manufacturing method.

In this embodiment of the present invention, the amount of Zr mixed in, when zirconia balls were used in mixing the raw materials and in mixing the calcined product, was 0.5 atomic % or below on the basis of the thermistor composing elements as 100 atomic % and the amount of Si mixed in, when agate balls were used, was similarly 1 atomic % or below. Of the samples listed in the table above, those containing Si were all obtained by using zirconia gems and stones. Further, $ZrO_2$ used in this embodiment was a product having Y therein as solid solution, i.e., partially stabilized zirconia with yttria. As this partially stabilized zirconia with yttria, products available on the market or those supplied by makers as samples were employed, but some of them were synthesized from oxalates.

FIG. 1 shows the aforementioned thermistor sealed in glass, in which 1 denotes the thermistor element of this invention; 2, electrode made of Pt as its main component; 3, glass; and 4 slag lead.

The reason it is advantages to use $ZrO_2$ having Y therein as solid solution will become apparent from the following description: utilizing $ZrO_2$ having 3 mols of $Y_2O_3$ therein as a solid solution (partially stabilized zirconia, hereinafter abbreviated to PSZ), a thermistor sealed in glass having a composition ratio of Mn : Ni : Cr : Zr (PSZ)=76.0 : 2.0 : 2.0 : 20.0 atomic % was prepared by the method shown in the aforementioned EXAMPLE 1. For comparison, another thermistor sealed in glass was prepared by separately using $Y_2O_3$ and $ZrO_2$ in the same proportion. In Table 2 below, the specific resistances at 25° C. and the thermistor constants at 300° C. and 500° C. of the aforementioned samples are listed. In Table 2, characteristics of a 4 component system of Mn-Ni-Cr-Zr system oxide semiconductors (patent application No. Sho 58-131265) these are jointly disclosed.

Figure 2:
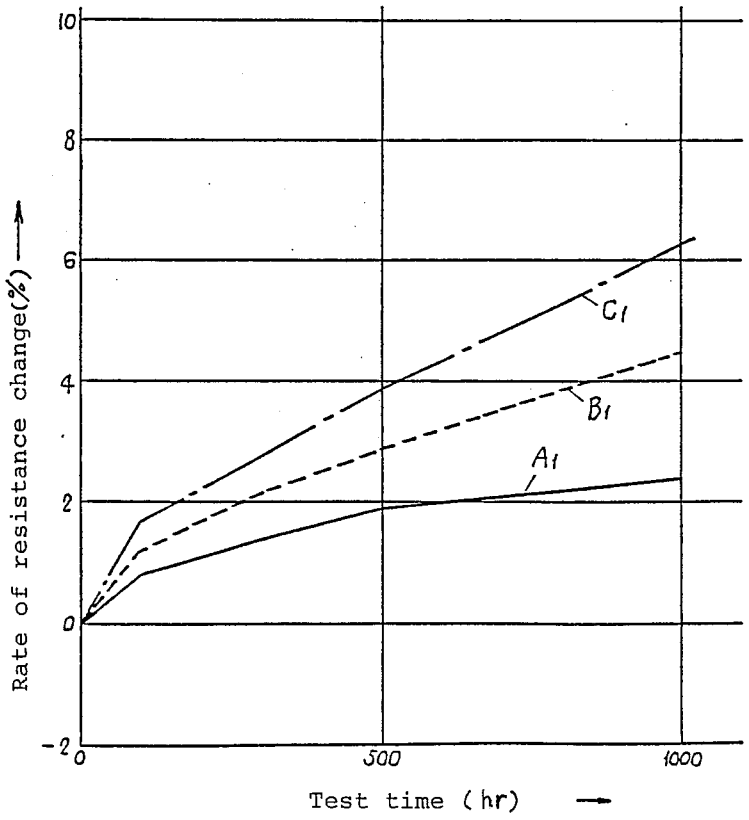
FIG. 2 through 6 portray characteristic graphs showing resistance changes with time at 500° C. of thermistors sealed in glass manufactured from the compositions of the present invention.

FIG. 2 gives the rates of resistance change with time at 500° C. of these thermistors. In this graph, $A_1$ represents the results obtained by using PSZ in the embodiment of this invention; $B_1$ gives those in a comparison sample with a 4 component system of Mn-Ni-Cr-Zr; and $C_1$ corresponds to another comparison example in which $Y_2O_3$ and $ZrO_2$ were separately added in place of PSZ. The samples have a dimension of 400 μm×400 μm×200 μm$^t$.

TABLE 2

| Sample No. | Sample | Specific resistance at 25° C. (Ω · cm) | Thermistor constant B ($R_{300°\ C.}/R_{500°\ C.}$) |
|---|---|---|---|
| 129 | Mn-Ni-Cr-PSZ system | 645K | 5870 (K) |
| *130 | Mn-Ni-Cr-Zr system | 670K | 5910 (K) |
| *131 | Mn-Ni-Cr-Y-Zr system | 980K | 6060 (K) |

(The mark * identifies comparison samples, which are outside of the claims of this invention.)

FIG. 2 clearly suggests that Sample No. 129 made by manufacturing method using PSZ excels those of Sample Nos. 130 and 131 in stability at high temperatures. Attention directed to the microstructure of the sample reveals that PSZ is existing as junctions or crystal grains themselves of the Mn-Ni-Cr system oxide spinel crystal. On the other hand, with the sample containing $Y_2O_3$ and $ZrO_2$ mixed separately at the same time, analysis of a ceramic section by use of an X-ray microanalyzer shows that $ZrO_2$ exists at the junctions of the spinel crystal or as crystal grains, but that Y is not preferentially contained in $ZrO_2$ as solid solution, but is nearly uniformly dispersed. Using X-ray diffraction, it was impossible to identify the Mn-Ni-Cr-Y system oxide. This time, the sensor was manufactured by sealing the element cut off from the block in glass, but it has been confirmed that a similar effect is achievable with bead type elements; thus, the invention is not bound by a sensor manufacturing method.

In this embodiment, zirconium oxide ZY (3 mols) manufactured by Shinnippon Kinzoku-Kagaku, K.K., was used as PSZ, with PSZ having more finely pulverized particle diameters and sharp grain size distributions, which are obtained by a Co-precipitation process, stability under the higher temperatures is believed to be more enhanced.

<EXAMPLE 2>

Next, an embodiment being a composition comprising 5 kinds of metal elements—Mn, Ni, Cr, magnesium (Mg) and Zr, to the sum total of 100 atomic %—is described: It is an oxide semiconductor comprising 5 kinds of metal elements—60.0–98.5 atomic % of Mn, 0.1–5.0 atomic % of Ni, 0.3–5.0 atomic % of Cr, 0.2–3.5 atomic % of Mg and 0.5–28.0 atomic % of Zr, to the sum total of 100 atomic %. Another embodiment further comprising Si added to the composition comprising 5 kinds of metal elements—Mn, Ni, Cr, Mg and Zr, to the sum total of 100 atomic %—at a predetermined rate on the basis of the gross amount thereof is described in conjunction with the aforementioned embodiment. Thus, this embodiment offers an oxide semiconductor for a thermistor further comprising Si added to the composition comprising 5 kinds of metal elements—60-.0–98.5 atomic % of Mn, 0.1–5.0 atomic % of Ni, 0.3–5.0 atomic % of Cr, 0.2–3.5 atomic % of Mg and 0.5–28.0 atomic % of Zr, to the sum total of 100 atomic %—at a rate of 2.0 atomic % or below (exclusive of 0 atomic %) on the basis of the gross amount thereof.

These embodiments are described hereunder: First, $MnCO_3$, NiO and $Cr_2O_3$, being materials available on the market, and $ZrO_2$ containing MgO therein as solid solution were proportioned to have the compositions represented by respective atomic % values shown in Table 3 below. And thermistors sealed in glass were manufactured through the same process as in EXAMPLE 1, and the initial characteristics at 25° C. and the B constants calculated by the aforementioned formula (1) from the resistance values at 300° C. and 500° C. are put up in the table in conjunction with other. The rates of resistance change with time at 500° C. were calculated from the resistance values obtained after a lapse of 1000 hr.

Figure 3:
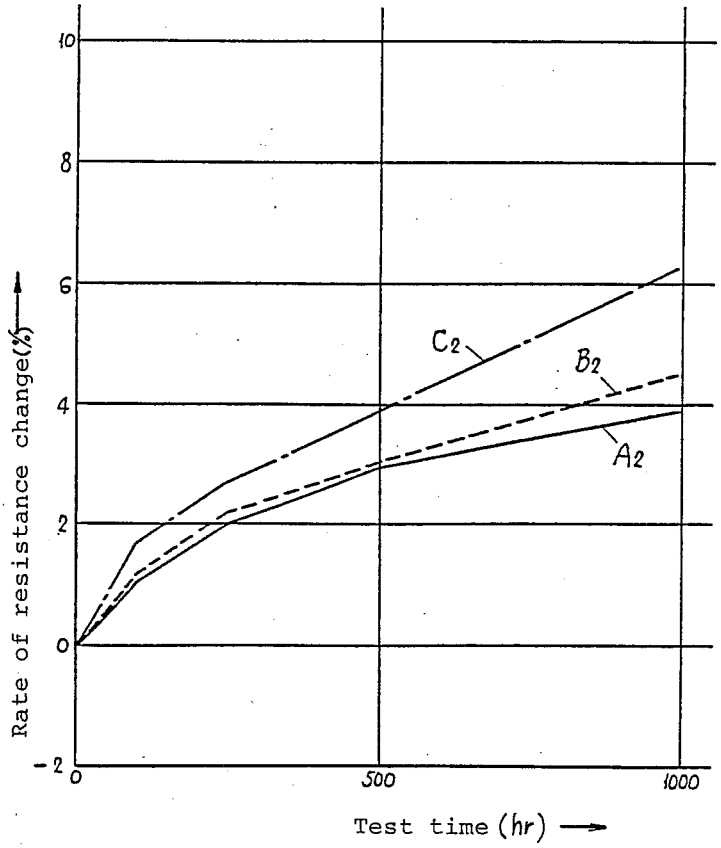

Further, Table 4 and FIG. 3 are evidence of the effect achieved by the use of $ZrO_2$ stabilized by containing Mg therein as solid solution, just as in EXAMPLE 1. In this FIG. 3, $A_2$ represents the results achieved with a thermistor sensor manufactured by utilizing the stabilized zirconia: $B_2$ corresponds to Mn-Ni-Cr-Zr system oxide previously offered, and $C_2$ refers to one obtained by adding magnesia and zirconia separately.

TABLE 3

| Sample No. | Sample composition (atom %) Mn | Ni | Cr | Mg | Zr | Si | $\rho_{25°\ C.}$ (Ω · cm) | $B\left(\frac{300°\ C.}{500°\ C.}\right)$ (K) | Rate of resistance change with time (%) |
|---|---|---|---|---|---|---|---|---|---|
| 201 | 69.5 | 5.0 | 5.0 | 0.5 | 20.0 | 0 | 403K | 5720 | 4.6 |
| *202 | 69.0 | 5.5 | 5.0 | 0.5 | 20.0 | 0 | 298K | 5510 | 6.0 |
| *203 | 72.0 | 2.0 | 5.5 | 0.5 | 20.0 | 0 | 550K | 5900 | 5.3 |
| *204 | 75.0 | 5.0 | 5.0 | 0 | 15.0 | 0 | 190K | 5410 | 10.3 |
| *205 | 68.0 | 1.5 | 1.5 | 4.0 | 25.0 | 0 | 684K | 6200 | 5.1 |
| 206 | 68.5 | 1.5 | 1.5 | 3.5 | 25.0 | 0 | 665K | 6220 | 4.7 |
| *207 | 81.8 | 0 | 2.3 | 0.9 | 15.0 | 0 | 1,640K | 7080 | 6.8 |
| *208 | 81.8 | 2.3 | 0 | 0.9 | 15.0 | 0 | 330K | 5640 | 7.5 |
| *209 | 98.6 | 0.4 | 0.3 | 0.2 | 0.5 | 0 | 971K | 6350 | 5.6 |
| *210 | 94.6 | 2.5 | 2.5 | 0.2 | 0.2 | 0 | 346K | 5590 | 6.4 |
| 211 | 63.0 | 2.0 | 5.0 | 2.0 | 28.0 | 0 | 890K | 6430 | 3.8 |
| 212 | 76.7 | 0.3 | 2.5 | 0.5 | 20.0 | 0 | 780K | 6370 | 3.4 |
| 213 | 97.8 | 0.5 | 1.0 | 0.2 | 0.5 | 0 | 993K | 6320 | 5.0 |
| 214 | 77.2 | 2.0 | 0.3 | 0.5 | 20.0 | 0 | 447K | 5610 | 4.9 |
| 215 | 75.0 | 2.0 | 2.0 | 1.0 | 20.0 | 0 | 586K | 6020 | 3.8 |
| 216 | 75.0 | 2.0 | 2.0 | 1.0 | 20.0 | 0.5 | 778K | 6390 | 4.3 |
| 217 | 75.0 | 2.0 | 2.0 | 1.0 | 20.0 | 1.0 | 1,110K | 6580 | 4.6 |
| 218 | 75.0 | 2.0 | 2.0 | 1.0 | 20.0 | 2.0 | 3.1 M | 6840 | 4.9 |
| *219 | 75.0 | 2.0 | 2.0 | 1.0 | 20.0 | 2.5 | 5.4 M | 7100 | 11.4 |
| 220 | 81.4 | 1.5 | 1.5 | 0.6 | 15.0 | 0.5 | 710K | 6260 | 4.1 |
| 221 | 90.0 | 0.3 | 4.5 | 0.2 | 5.0 | 0 | 540K | 5790 | 4.7 |

TABLE 3-continued

| Sample No. | Sample composition (atom %) Mn | Ni | Cr | Mg | Zr | Si | $\rho_{25° C.}$ (Ω · cm) | $B\left(\frac{300° C.}{500° C.}\right)$ (K) | Rate of resistance change with time (%) |
|---|---|---|---|---|---|---|---|---|---|
| 222 | 79.9 | 1.0 | 3.5 | 0.6 | 15.0 | 0.3 | 830K | 6570 | 3.9 |
| 223 | 81.4 | 1.0 | 2.0 | 0.6 | 15.0 | 0 | 486K | 5610 | 4.6 |
| *224 | 59.5 | 4.5 | 4.5 | 3.5 | 28.0 | 0 | 571K | 5790 | 8.4 |
| *225 | 64.0 | 2.0 | 2.0 | 2.0 | 30.0 | 0 | 1,320K | 7060 | 6.3 |
| 226 | 60.0 | 4.0 | 4.5 | 3.5 | 28.0 | 0 | 634K | 5880 | 4.7 |

(The mark * identifies comparison samples.)

TABLE 4

| Sample No. | Sample | Specific resistance at 25° C. (Ω · cm) | Thermistor constant B (300° C./500° C.) |
|---|---|---|---|
| 227 | Mn-Ni-Cr-Zr(Mg) | 710 KΩcm | 6220K |
| *228 | Mn-Ni-Cr-Zr | 670 KΩcm | 5910K |
| *229 | Mn-Ni-Cr-Mg-Zr | 850 KΩcm | 6350K |

(The mark * identifies comparison samples, which are outside of the claims of this invention.)

FIG. 3 clearly shows that the product of Sample No. 227 in which the stabilized zirconia is used excels those of Sample Nos. 228 and 229 in stability at high temperatures. Of the samples listed in Table 3 above, Sample Nos. 204, 207 and 208 are comparison samples of 4 component system and Sample Nos. 202, 203, 205, 209, 210, 219, 224 and 225 are also comparison samples; all of them were found lacking in stability in practical use, giving the rates of resistance change with time at 500° C. in excess of 5%.

As hereabove described, the samples used for measuring the rates of resistance change with time were sintered after dry pressing; however, bead type elements may be used; thus, this invention is not bound by the element manufacturing method.

In EXAMPLE 2 of the present invention, the amount of Zr mixed in when zirconia balls were used in mixing materials and in milling the calcined product was 0.5 atomic % or below on the basis of the thermistor constituent elements as 100 atomic % and the amount of Si mixed in when agate balls were used was 1 atomic % or below. Of the samples shown in Table 3 above, samples containing Si were obtained by using zirconia balls. The $ZrO_2$ used in the examples was obtained by containing Mg therein as solid solution; thus, it was stabilized zirconia. As this stabilized zirconia, products available on the market or those supplied as samples by material makers were employed, but some of them used were synthesized from oxalates. The microstructure of ceramic, like the one in the previous example, is composed of two phases of Mn-Ni-Cr system oxide spinel crystal and $ZrO_2$.

<EXAMPLE 3>

Next, an embodiment being a composition comprising 5 kinds of metal elements—Mn, Ni, Cr, calcium (Ca) and Zr, to the sum total of 100 atomic %—is described: It is an oxide semiconductor comprising 5 kinds of metal elements—60.0–98.5 atomic % of Mn, 0.1–5.0 atomic % of Ni, 0.3–5.0 atomic % of Cr, 0.2–3.5 atomic % of Ca and 0.5–28.0 atomic % of Zr, to the sum total of 100 atomic %. Another embodiment further comprising Si added to the composition comprising 5 kinds of metal elements—Mn, Ni, Cr, Ca and Zr, to the sum total of 100 atomic %—at a predetermined rate on the basis of the gross amount thereof is described in conjunction with the aforementioned embodiment. Thus, this embodiment offers an oxide semiconductor for a thermistor further comprising Si added to the composition comprising 5 kinds of metal elements—60.0–98.5 atomic % of Mn, 0.1–5.0 atomic % of Ni, 0.3–5.0 atomic % of Cr, 0.2–3.5 atomic % of Ca and 0.5–28.0 atomic % of Zr, to the sum total of 100 atomic %—at a rate of 2.0 atomic % or below (exclusive of 0 atomic %) on the basis of the gross amount thereof.

These embodiments are described hereunder: First, $MnCO_3$, NiO and $Cr_2O_3$, materials available on the market, and $ZrO_2$ containing CaO therein as solid solution were proportioned to have the compositions represented by respective atomic % values shown in Table 5 below. Thermistors sealed in glass were manufactured through the same process as in EXAMPLE 1, and the initial characteristics at 25° C. and the B constants calculated by the aforementioned formula (1) from the resistance values at 300° C. and 500° C. are disclosed in the table in conjunction. The rates of resistance change with time at 500° C. were calculated from the resistance values obtained after a lapse of 1000 hr.

Figure 4:
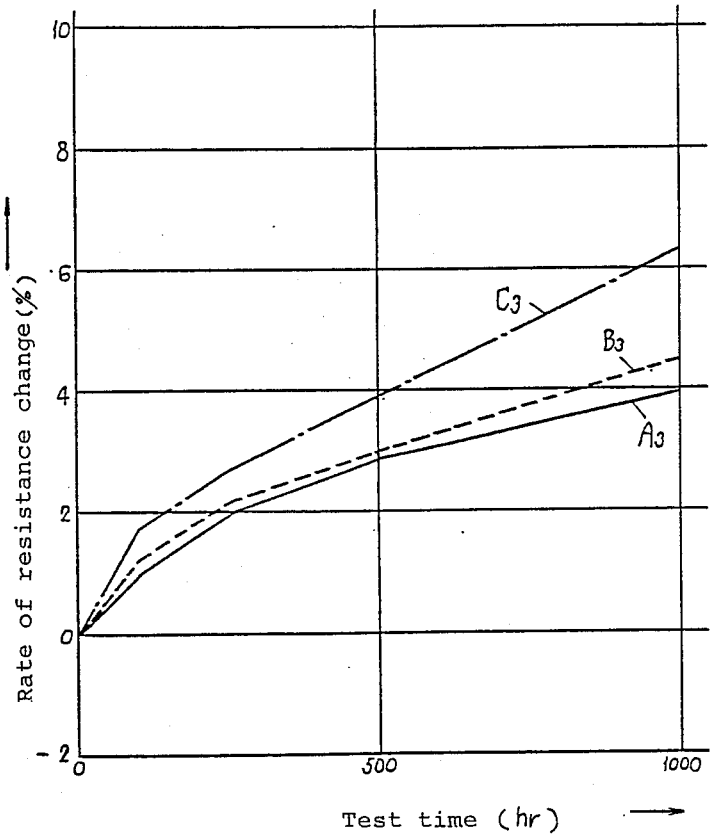

Further, Table 6 and FIG. 4 are evidence of the effect achieved by the use of $ZrO_2$ stabilized by containing Ca therein as solid solution, just as in EXAMPLE 1. In this FIG. 4, $A_3$ represents the results achieved with a thermistor sensor manufactured by utilizing the stabilized zirconia; $B_3$ corresponds to Mn-Ni-Cr-Zr system oxide previously offered, and $C_3$ refers to one obtained by adding calcia and zirconia separately.

TABLE 5

| Sample No. | Sample composition (atom %) Mn | Ni | Cr | Ca | Zr | Si | $\rho_{25° C.}$ (Ω · cm) | $B\left(\frac{300° C.}{500° C.}\right)$ (K) | Rate of resistance change with time (%) |
|---|---|---|---|---|---|---|---|---|---|
| 301 | 69.3 | 5.0 | 5.0 | 0.7 | 20.0 | 0 | 325K | 5540 | 4.8 |
| *302 | 68.8 | 5.5 | 5.0 | 0.7 | 20.0 | 0 | 262K | 5470 | 5.8 |
| *303 | 71.8 | 2.0 | 5.5 | 0.7 | 20.0 | 0 | 480K | 5760 | 5.2 |
| *304 | 75.0 | 5.0 | 5.0 | 0 | 15.0 | 0 | 190K | 5410 | 10.3 |
| *305 | 68.0 | 1.5 | 1.5 | 4.0 | 25.0 | 0 | 632K | 6090 | 6.4 |
| 306 | 68.5 | 1.5 | 1.5 | 3.5 | 25.0 | 0 | 609K | 6070 | 4.9 |
| *307 | 82.5 | 0 | 2.0 | 0.5 | 15.0 | 0 | 1.2 M | 6640 | 7.5 |
| *308 | 82.5 | 2.0 | 0 | 0.5 | 15.0 | 0 | 370K | 5630 | 6.2 |

TABLE 5-continued

| Sample No. | Sample composition (atom %) Mn | Ni | Cr | Ca | Zr | Si | $\rho_{25° C.}$ (Ω · cm) | $B\left(\frac{300° C.}{500° C.}\right)$ (K) | Rate of resistance change with time (%) |
|---|---|---|---|---|---|---|---|---|---|
| *309 | 98.6 | 0.4 | 0.3 | 0.2 | 0.5 | 0 | 968K | 6340 | 5.6 |
| *310 | 94.6 | 2.5 | 2.5 | 0.2 | 0.2 | 0 | 350K | 5530 | 6.4 |
| 311 | 64.0 | 2.0 | 5.0 | 1.0 | 28.0 | 0 | 825K | 6420 | 3.9 |
| *312 | 59.5 | 4.5 | 4.5 | 3.5 | 28.0 | 0 | 541K | 5780 | 7.8 |
| 313 | 77.0 | 2.0 | 0.3 | 0.7 | 20.0 | 0 | 418K | 5670 | 4.8 |
| 314 | 76.5 | 0.3 | 2.5 | 0.7 | 20.0 | 0 | 763K | 6290 | 4.2 |
| 315 | 97.8 | 0.5 | 1.0 | 0.2 | 0.5 | 0 | 990K | 6320 | 5.0 |
| 316 | 74.9 | 2.0 | 2.0 | 1.1 | 20.0 | 0 | 515K | 5970 | 3.9 |
| 317 | 74.9 | 2.0 | 2.0 | 1.1 | 20.0 | 0.5 | 729K | 6270 | 4.2 |
| 318 | 74.9 | 2.0 | 2.0 | 1.1 | 20.0 | 1.0 | 940K | 6490 | 4.4 |
| 319 | 74.9 | 2.0 | 2.0 | 1.1 | 20.0 | 2.0 | 2.3 M | 6800 | 5.0 |
| *320 | 74.9 | 2.0 | 2.0 | 1.1 | 20.0 | 2.5 | 5.4 M | 7070 | 9.8 |
| 321 | 79.6 | 1.0 | 3.5 | 0.9 | 15.0 | 0.3 | 708K | 6250 | 4.0 |
| 322 | 90.0 | 1.0 | 3.5 | 0.5 | 5.0 | 0 | 580K | 5800 | 4.7 |
| 323 | 69.0 | 2.0 | 2.0 | 2.0 | 25.0 | 0 | 750K | 6290 | 3.8 |
| 324 | 76.3 | 1.5 | 1.5 | 0.7 | 20.0 | 0.5 | 723K | 6250 | 4.1 |
| 325 | 81.8 | 3.0 | 5.0 | 0.2 | 10.0 | 0 | 545K | 5820 | 4.8 |
| 326 | 60.0 | 4.0 | 4.5 | 3.5 | 28.0 | 0 | 602K | 5870 | 4.6 |

TABLE 6

| Sample No. | Sample | Specific resistance at 25° C. (Ω · cm) | Thermistor constant B (300° C./500° C.) |
|---|---|---|---|
| 327 | Mn-Ni-Cr-Zr(Ca) | 640 KΩcm | 6030K |
| *328 | Mn-Ni-Cr-Zr | 670 KΩcm | 5910K |
| *329 | Mn-Ni-Cr-Ca-Zr | 530 KΩcm | 5750K |

(The mark * indentifies comparison sample.)

FIG. 4 clearly shows that the product of Sample No. 327 produced by the manufacturing method of this invention excels those of Sample Nos. 328 and 329 in stability at high temperatures.

Of the samples listed in Table 5 above, Sample Nos. 304, 307 and 308 are comparison samples of 4 component system and Samples Nos. 302, 303, 305, 309, 310, 312 and 320 are also comparison samples; all of them were found to lack stability in practical use, giving the rates of resistance change with time at 500° C. in excess of 5%.

As hereabove described, the samples used for measuring the rates of resistance change with time were sintered after dry pressing; however, bead type elements may be used; thus, this invention is not bound by the element manufacturing method.

In EXAMPLE 3 of the present invention, the amount of Zr mixed in when zirconia balls were used in mixing materials and in milling the calcined product was 0.5 atomic % or below on the basis of the thermistor composing elements as 100 atomic % and the amount of Si mixed in when agate balls were used was 1 atomic % or below. Of the samples shown in the table above, samples containing Si were obtained by using zirconia balls. The $ZrO_2$ used in the examples was all obtained by containing Ca therein as solid solution; thus, it was a stabilized zirconia. As this stabilized zirconia, products available on the market or those supplied as samples by material makers were employed, but some of them used were synthesized from oxalates. The microstructure of ceramic, like the one in the previous example, is composed of two phases of Mn-Ni-Cr system oxide spinel crystal and $ZrO_2$.

<EXAMPLE 4>

Next, an embodiment being a composition comprising 5 kinds of metal elements—Mn, Ni, Cr lanthanum (La) and Zr, to the sum total of 100 atomic %—is described: It is an oxide semiconductor comprising 5 kinds of metal elements—60.0–98.5 atomic % of Mn, 0.1–5.0 atomic % of Ni, 0.3–5.0 atomic % of Cr, 0.2–5.0 atomic % of La and 0.5–28.0 atomic % of Zr, to the sum total of 100 atomic %. Another embodiment further comprising Si added to the composition comprising 5 kinds of metal elements—Mn, Ni, Cr, La and Zr, to the sum total of 100 atomic %—at a predetermined rate on the basis of the gross amount thereof is described in conjunction with the aforementioned embodiment. Thus, this embodiment provides an oxide semiconductor for a thermistor further comprising Si added to the composition comprising 5 kinds of metal elements—60.0–98.5 atomic % of Mn, 0.1–5.0 atomic % of Ni, 0.3–5.0 atomic % of Cr, 0.2–5.0 atomic % of La and 0.5–28.0 atomic % of Zr, to the sum total of 100 atomic %—at a rate of 2.0 atomic % or below (exclusive of 0 atomic %) on the basis of the gross amount thereof.

These embodiments are described hereunder: First, $MnCO_3$, NiO and $Cr_2O_3$, materials available on the market, and $ZrO_2$ containing $La_2O_3$ therein as solid solution were proportioned to have the compositions represented by respective atomic % values shown in Table 7 below. Thermistors sealed in glass were manufactured through the same process as in EXAMPLE 1, and the initial characteristics obtained with them at 25° C. and the B constants calculated by the aforementioned formula (1) from the resistance values at 300° C. and 500° C. are disclosed in the table in conjunction with other data. The rate of resistance change with time at 500° C. was calculated from the resistance values obtained after a lapse of 1000 hr.

Figure 5:
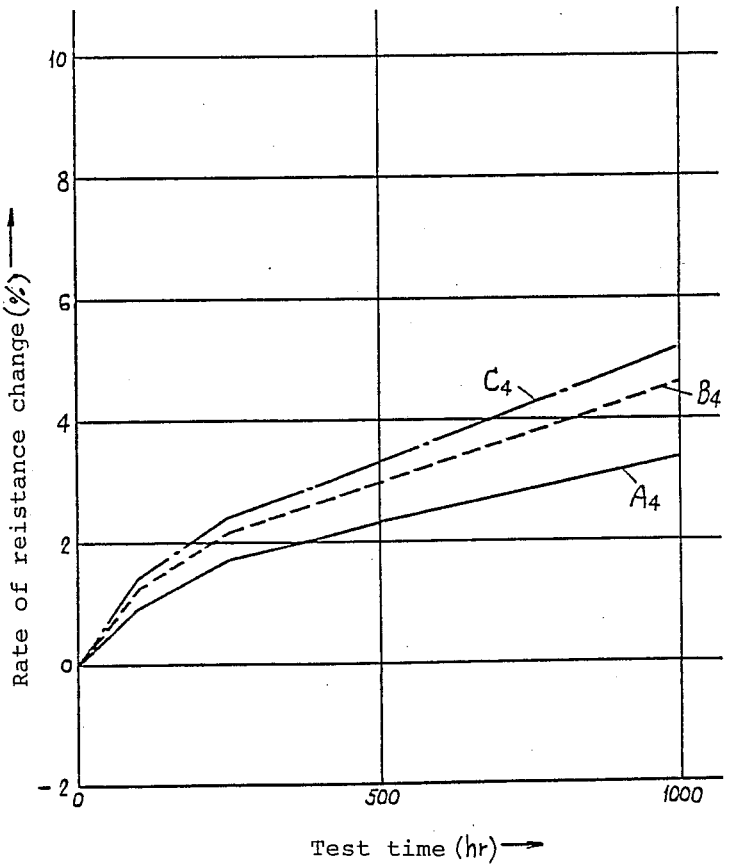

Further, Table 8 below and FIG. 5 are evidence of the effect achieved by the use of $ZrO_2$ stabilized by containing La therein as solid solution, just as in EXAMPLE 1. In this FIG. 5, $A_4$ represents the results achieved with a thermistor sensor manufactured by utilizing the stabilized zirconia; $B_4$ corresponds to Mn-Ni-Cr-Zr system oxide previously offered, and $C_4$ refers to one obtained by adding lanthanum oxide and zirconia separately.

TABLE 7

| Sample No. | Sample composition (atom %) Mn | Ni | Cr | La | Zr | Si | $\rho_{25° C.}$ (Ω · cm) | $B\left(\frac{300° C.}{500° C.}\right)$ (K) | Rate of resistance change with time (%) |
|---|---|---|---|---|---|---|---|---|---|
| 401 | 69.5 | 5.0 | 5.0 | 0.5 | 20.0 | 0 | 350K | 5650 | 4.7 |
| *402 | 69.0 | 5.5 | 5.0 | 0.5 | 20.0 | 0 | 290K | 5510 | 5.8 |
| *403 | 72.0 | 2.0 | 5.5 | 0.5 | 20.0 | 0 | 503K | 5830 | 5.1 |
| 404 | 76.0 | 2.0 | 2.0 | 0.6 | 19.4 | 0 | 744K | 6050 | 3.9 |
| *405 | 75.0 | 5.0 | 5.0 | 0 | 15.0 | 0 | 190K | 5410 | 10.3 |
| 406 | 68.5 | 2.5 | 2.5 | 1.5 | 25.0 | 0 | 718K | 6030 | 4.1 |
| *407 | 64.0 | 1.0 | 4.0 | 1.0 | 30.0 | 0 | 875K | 6300 | 5.4 |
| 408 | 65.7 | 1.0 | 3.5 | 1.8 | 28.0 | 0 | 850K | 6260 | 4.3 |
| *409 | 98.6 | 0.4 | 0.3 | 0.2 | 0.5 | 0 | 980K | 6350 | 5.8 |
| 410 | 90.0 | 0.3 | 4.5 | 0.2 | 5.0 | 0 | 540K | 5800 | 4.9 |
| *411 | 64.5 | 2.5 | 2.5 | 5.5 | 25.0 | 0 | 779K | 6140 | 5.3 |
| 412 | 62.5 | 1.0 | 3.5 | 5.0 | 28.0 | 0 | 914K | 6370 | 5.0 |
| *413 | 81.8 | 0 | 2.3 | 0.9 | 15.0 | 0 | 1.3 M | 6810 | 8.3 |
| *414 | 81.8 | 2.3 | 0 | 0.9 | 15.0 | 0 | 283 M | 5560 | 6.5 |
| 415 | 74.8 | 2.0 | 2.0 | 1.2 | 20.0 | 0 | 576K | 6030 | 3.6 |
| 416 | 74.8 | 2.0 | 2.0 | 1.2 | 20.0 | 0.5 | 807K | 6220 | 3.9 |
| 417 | 74.8 | 2.0 | 2.0 | 1.2 | 20.0 | 1.0 | 1,044K | 6530 | 4.4 |
| 418 | 74.8 | 2.0 | 2.0 | 1.2 | 20.0 | 2.0 | 2.5 M | 6910 | 4.8 |
| *419 | 74.8 | 2.0 | 2.0 | 1.2 | 20.0 | 2.5 | 5.6 M | 7640 | 7.4 |
| 420 | 77.5 | 1.0 | 0.3 | 1.2 | 20.0 | 0.3 | 865K | 6290 | 4.6 |

(The mark * identifies comparison sample.)

TABLE 8

| Sample No. | Sample | Specific resistance at 25° C. (Ω · cm) | Thermistor constant B (300° C./500° C.) |
|---|---|---|---|
| 421 | Mn-Ni-Cr-Zr(La) | 650 KΩ · cm | 5940K |
| *422 | Mn-Ni-Cr-Zr | 670 KΩ · cm | 5910K |
| *423 | Mn-Ni-Cr-La-Zr | 790 KΩ · cm | 6160K |

(The mark * identifies comparison samples.)

FIG. 5 clearly shows that the product of Sample No. 421 produced by the manufacturing method of this invention excels those of Sample Nos. 422 and 423 in stability at high temperatures.

Of the samples listed in Table 7 above, Sample Nos. 405, 413 and 414 are comparison samples of 4 component system and Sample Nos. 402, 403, 407, 409, 411 and 419 are also comparison samples; all of them were found to lack stability in practical use, giving the rates of resistance change with time at 500° C. in excess of 5%.

As hereabove described, the samples used for measuring the rates of resistance change with time were sintered after dry pressing; however, bead type elements may be used; thus, this invention is not bound by the element manufacturing method.

In EXAMPLE 4 of the present invention, the amount of Zr mixed in when zirconia balls were used in mixing materials and in pulverizing and mixing the calcined product was 0.5 atomic % or below on the basis of the thermistor constituent elements as 100 atomic % and the amount of Si mixed in when agate balls were used was likewise 1 atomic % or below. Of the samples shown in the table above, samples containing Si were obtained by using zirconia balls. The $ZrO_2$ used in the examples was all obtained by containing La therein as solid solution; thus, it was stabilized zirconia. As this stabilized zirconia, products available on the market or those supplied as samples by material makers were employed, but some of them used were synthesized from oxalates. The microstructure of ceramic, like the one in the previous example, is composed of two phases of Mn-Ni-Cr system oxide spinel crystal and $ZrO_2$.

<EXAMPLE 5>

Next, an embodiment being a composition comprising 5 kinds of metal elements—Mn, Ni, Cr, ytterbium (Yb) and Zr, to the sum total of 100 atomic %—is described: It is an oxide semiconductor comprising 5 kinds of metal elements—60.0–98.5 atomic % of Mn, 0.1–5.0 atomic % of Ni, 0.3–5.0 atomic % of Cr, 0.2–5.0 atomic % of Yb and 0.5–28.0 atomic % of Zr, to the sum total of 100 atomic %. Another embodiment further comprising Si added to the composition comprising 5 kinds of metal elements—Mn, Ni, Cr, Yb and Zr, to the sum total of 100 atomic %—at a predetermined rate on the basis of the gross amount thereof is described in conjunction with the aforementioned embodiment. Thus, this embodiment provides an oxide semiconductor for a thermistor further comprising Si added to the composition comprising 5 kinds of metal elements—60.0–98.5 atomic % of Mn, 0.1–5.0 atomic % of Ni, 0.3–5.0 atomic % of Cr, 0.2–5.0 atomic % of Yb and 0.5–28.0 atomic % of Zr, to the sum total of 100 atomic %—at a rate of 2.0 atomic % or below (exclusive of 0 atomic %) on the basis of the gross amount thereof.

These embodiments are described hereunder: First, $MnCO_3$, NiO and $Cr_2O_3$, being materials available on the market, and $ZrO_2$ containing $Y_2O_3$ therein as solid solution were proportioned to have the compositions represented by respective atomic % values shown in Table 9 below. And thermistors sealed in glass were manufactured through the same processes as in EXAMPLE 1, and the initial characteristics obtained with them at 25° C. and the B constants calculated by the aforementioned formula (1) from the resistance values at 300° C. and 500° C. are put up in the table in conjunction with other data. The rates of resistance changes with time at 500° C. were calculated from the resistance values obtained after a lapse of 1000 hr.

Figure 6:
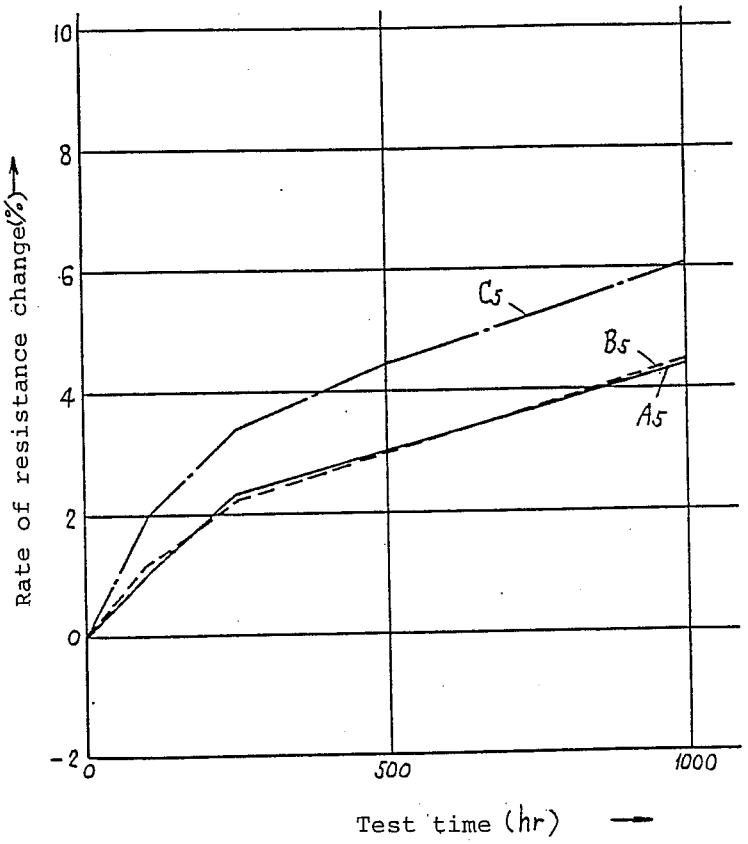

Further, Table 10 below and FIG. 6 give evidences of the effect achieved by the use of $ZrO_2$ stabilized by containing Yb therein as solid solution, just as in EXAMPLE 1. In this FIG. 6, $A_5$ represents the results achieved with a thermistor sensor manufactured by utilizing the stabilized zirconia; $B_5$ corresponds to Mn-Ni-Cr-Zr system oxide previously offered, and $C_5$ refers to the curve obtained by adding ytterbium oxide and zirconia separately.

TABLE 9

| Sample No. | Sample composition (atom %) Mn | Ni | Cr | Y | Zr | Si | $\rho_{25°\,C.}$ (ω · cm) | $B\left(\frac{300°\,C.}{500°\,C.}\right)$ | Rate of resistance change with time (%) |
|---|---|---|---|---|---|---|---|---|---|
| 801 | 69.5 | 5.0 | 5.0 | 0.5 | 20.0 | 0 | 415K | 5,720 | 4.6 |
| *802 | 69.0 | 5.5 | 5.0 | 0.5 | 20.0 | 0 | 328K | 5,570 | 5.9 |
| *803 | 72.0 | 2.0 | 5.5 | 0.5 | 20.0 | 0 | 594K | 5,910 | 5.3 |
| 804 | 74.8 | 2.0 | 2.0 | 1.2 | 20.0 | 0 | 630K | 6,090 | 3.0 |
| 805 | 60.0 | 2.5 | 4.5 | 5.0 | 28.0 | 0 | 963K | 6,420 | 5.0 |
| *806 | 64.0 | 1.0 | 4.0 | 1.0 | 30.0 | 0 | 1,067K | 6,490 | 5.5 |
| *807 | 98.6 | 0.4 | 0.3 | 0.2 | 0.5 | 0 | 1,098K | 6,470 | 5.8 |
| 808 | 98.5 | 0.5 | 0.3 | 0.2 | 0.5 | 0 | 1,037K | 6,440 | 5.0 |
| *809 | 82.1 | 2.3 | 0 | 0.6 | 15.0 | 0 | 310K | 5,530 | 6.2 |
| *810 | 82.1 | 0 | 2.3 | 0.6 | 15.0 | 0 | 1.5 M | 6,790 | 7.6 |
| *811 | 59.0 | 3.5 | 4.5 | 5.0 | 28.0 | 0 | 891K | 6,360 | 5.4 |
| *812 | 94.6 | 2.5 | 2.5 | 0.2 | 0.2 | 0 | 284K | 5,510 | 5.3 |
| *813 | 75.0 | 5.0 | 5.0 | 0 | 15.0 | 0 | 190K | 5,410 | 10.3 |
| 814 | 74.8 | 2.0 | 2.0 | 1.2 | 20.0 | 0.5 | 840K | 6,290 | 3.5 |
| 815 | 74.8 | 2.0 | 2.0 | 1.2 | 20.0 | 1.0 | 1,062K | 6,490 | 3.7 |
| 816 | 74.8 | 2.0 | 2.0 | 1.2 | 20.0 | 2.0 | 2.5 M | 6,940 | 4.8 |
| *817 | 74.8 | 2.0 | 2.0 | 1.2 | 20.0 | 2.5 | 5.6 M | 7,900 | 12.1 |
| 818 | 80.4 | 1.5 | 2.5 | 0.6 | 15.0 | 0.5 | 715K | 6,140 | 4.6 |
| 819 | 84.7 | 1.0 | 4.0 | 0.3 | 10.0 | 0.3 | 739K | 6,190 | 4.4 |
| 820 | 68.0 | 1.5 | 2.5 | 3.0 | 25.0 | 0 | 745K | 6,160 | 3.9 |
| *821 | 61.5 | 2.5 | 2.5 | 5.5 | 28.0 | 0 | 880K | 6,340 | 5.7 |

(The mark * identifies comparison sample.)

TABLE 10

| Sample No. | Sample | Specific resistance at 25° C. | Thermistor constant B (300° C./500° C.) |
|---|---|---|---|
| 822 | Mn-Ni-Cr-Zr(Yb) | 770 K Ω · cm | 6220K |
| *823 | Mn-Ni-Cr-Zr | 670 K Ω · cm | 5910K |
| *824 | Mn-Ni-Cr-Yb-Zr | 920 K Ω · cm | 6470K |

(The mark * indentifies comparison sample.)

FIG. 6 clearly shows that the product of Sample No. 822 produced by the manufacturing method of this invention excels those of Samples Nos. 823 and 824 in stability at high temperatures. Of the samples listed in Table 9 above, Sample Nos. 809, 810 and 813 are comparison samples of 4 component system and Samples Nos. 802, 803, 806, 807, 811, 812, 817 and 821 are also comparison samples; all of them were found to lack in stability in practical use, giving the rate of resistance change with time at 500° C. in excess of 5%.

As hereabove described, the samples used for measuring the rates of resistance change with time were sintered after dry pressing; however, bead type elements may be used; thus, this invention is not bound by the element manufacturing method.

In EXAMPLE 5 of the present invention, the amount of Zr mixed in when zirconia balls were used in mixing materials and in milling the calcined product was 0.5 atomic % or below on the basis of the thermistor constituent elements at 100 atomic % and the amount of Si mixed in when agate balls were used was likewise 1 atomic % or below. Of the samples shown in the table above, samples containing Si were obtained by using zirconia balls. The $ZrO_2$ used in the examples was all obtained by containing Yb therein as solid solution; thus, it was a stabilized zirconia. As this stabilized zirconia, products available on the market or those supplied as samples by material makers were employed, but some of them used were synthesized from oxalates. The microstructure of ceramic, like the one in the previous example, is composed of two phases of Mn-Ni-Cr system oxide spinel crystal and $ZrO_2$.

It may be deduced in sum that in all compositions of EXAMPLES 1 through 5, the addition of the stabilized zirconia effects to stabilize the thermistor at high temperatures. The effect of addition of $SiO_2$ is evidenced in the high density due to accelerated sintering and the control of specific resistance.

The limitation for the aforementioned composition range is set regarding the rate of resistance change with time within ±5% (after a lapse of 1000 hr) in high temperature life test as the standard, as applied in Tables 1, 3, 5, 7 and 9; products which give values in excess of ±5% were excluded from the acceptable range regarding them as of lacking in reliability.

INDUSTRIAL APPLICABILITY

As described in the foregoing, the oxide semiconductors for thermistors have excellent characteristics as temperature sensors for use at intermediary and high temperature ranges; that is, giving the rate of resistance change with time at temperatures of 200°-500° C. as small as within ±5%, it is most suitable for temperature measurement where high reliability is required at high temperatures. Its utility value is highly appreciated in such fields as temperature control of electronic ranges and preheater pots of petroleum fan heaters, etc..

I claim:

1. An oxide semiconductor for a thermistor made of a sintered mixture of metal oxides and useful as a temperature sensor in a middle temperature range of about 200° C. to at least 500° C., comprising 60.0–98.5 atomic % of manganese (Mn), 0.1–5.0 atomic % of nickel (Ni), 0.3–5.0 atomic % of chromium (Cr), 0.2–5.0 atomic % of yttrium (Y) and 0.5–28.0 atomic % of zirconium (Zr), to the sum total of 100 atomic %.

2. An oxide semiconductor for a thermistor in accordance with claim 1 wherein said oxide semiconductor for a thermistor is constituted by utilizing stabilized zirconia ($ZrO_2$) containing yttria ($Y_2O_3$) therein as solid solution.

3. An oxide semiconductor for a thermistor made of a sintered mixture of metal oxides and useful as a temperature sensor in a middle temperature range of about 200° C. to at least 500° C., comprising 60.0–98.5 atomic % of manganese (Mn), 0.1–5.0 atomic % of nickel (Ni), 0.3–5.0 atomic % of chromium (Cr), 0.2–5.0 atomic % of yttrium (Y) and 0.5–28.0 atomic % of zirconium (Zr), to the sum total of 100 atomic %—and which further contains silicon (Si) at a rate of 0.05–2.0 atomic % on the basis of the total amount of components exclusive of silicon (Si).

4. An oxide semiconductor for a thermistor in accordance with claim 3 wherein said oxide semiconductor for a thermistor is constituted by utilizing stabilized zirconia ($ZrO_2$) containing yttria ($Y_2O_3$) therein as solid solution.

5. An oxide semiconductor for a thermistor made of a sintered mixture of metal oxides and useful as a temperature sensor in a middle temperature range of about 200° C. to at least 500° C., comprising 60.0–98.5 atomic % of manganese (Mn), 0.1–5.0 atomic % of nickel (Ni), 0.3–5.0 atomic % of chromium (Cr), 0.2–3.5 atomic % of magnesium (Mg) and 0.5–28.0 atomic % of zirconium (Zr), to the sum total of 100 atomic %.

6. An oxide semiconductor for a thermistor in accordance with claim 5 wherein said oxide semiconductor for a thermistor is constituted by utilizing stabilized zirconia ($ZrO_2$) containing magnesia (MgO) therein as solid solution.

7. An oxide semiconductor for a thermistor made of a sintered mixture of metal oxides and useful as a temperature sensor in a middle temperature range of about 200° C. to at least 500° C., comprising 60.0–98.5 atomic % of manganese (Mn), 0.1–5.0 atomic % of nickel (Ni), 0.3–5.0 atomic % of chromium (Cr). 0.2–3.5 atomic % of magnesium (Mg) and 0.5–28.0 atomic % of zirconium (Zr), to the sum total of 100 atomic %—and which further contains silicon (Si) at a rate of 0.05–2.0 atomic % on the basis of the total amount of components exclusive of silicon (Si).

8. An oxide semiconductor for a thermistor in accordance with claim 7 wherein said oxide semiconductor for a thermistor is constituted by utilizing stabilized zirconia ($ZrO_2$) containing magnesia (MgO) therein as solid solution.

9. An oxide semiconductor for a thermistor made of a sintered mixture of metal oxides and useful as a temperature sensor in a middle temperature range of about 200° C. to at least 500° C., comprising 60.0–98.5 atomic % of manganese (Mn), 0.1–5.0 atomic % of nickel (Ni), 0.3–5.0 atomic % of chromium (Cr), 0.2–3.5 atomic % of calcium (Ca) and 0.5–28.0 atomic % of zirconium (Zr), to the sum total of 100 atomic %.

10. An oxide semiconductor for a thermistor in accordance with claim 9 wherein said oxide semiconductor for a thermistor is constituted by utilizing stabilized zirconia ($ZrO_2$) containing calcia (CaO) therein as solid solution.

11. An oxide semiconductor for a thermistor made of a sintered mixture of metal oxides and useful as a temperature sensor in a middle temperature range of about 200° C. to at least 500° C., comprising 60.0–98.5 atomic % of manganese (Mn), 0.1–5.0 atomic % of nickel (Ni), 0.3–5.0 atomic % of chromium (Cr), 0.2–3.5 atomic % of Calcium (Ca) and 0.5–28.0 atomic % of zirconium (Zr), to the sum total of 100 atomic %—and which further contains silicon (Si) at a rate of 0.05–2.0 atomic % on the basis of the total amount of components exclusive of silicon (Si).

12. An oxide semiconductor for a thermistor in accordance with claim 11 wherein said oxide semiconductor for a thermistor is constituted by utilizing stabilized zirconia ($ZrO_2$) containing calcia (CaO) therein as solid solution.

13. An oxide semiconductor for a thermistor made of a sintered mixture of metal oxides and useful as a temperature sensor in a middle temperature range of about 200° C. to at least 500° C., comprising 60.0–98.5 atomic % of manganese (Mn), 0.1–5.0 atomic % of nickel (Ni), 0.3–5.0 atomic % of chromium (Cr), 0.2–5.0 atomic % of lanthanum (La) and 0.5–28.0 atomic % of zirconium (Zr), to the sum total of 100 atomic %.

14. An oxide semiconductor for a thermistor in accordance with claim 13 wherein said oxide semiconductor for a thermistor is constituted by utilizing stabilized zirconia ($ZrO_2$) containing lanthanum oxide ($La_2O_3$) therein as solid solution.

15. An oxide semiconductor for a thermistor made of a sintered mixture of metal oxides and useful as temperature sensor in a middle temperature range of about 200° C. to at least 500° C., comprising 60.0–98.5 atomic % of manganese (Mn), 0.1–5.0 atomic % of nickel (Ni), 0.3–5.0 atomic % of chromium (Cr), 0.2–5.0 atomic % of lanthanum (La) and 0.5–28.0 atomic % of zirconium (Zr), to the sum total of 100 atomic %—and which further contains silicon (Si) at a rate of 0.05–2.0 atomic % on the basis of the total amount of components exclusive of silicon (Si).

16. An oxide semiconductor for a thermistor in accordance with claim 15 wherein said oxide semiconductor for a thermistor is constituted by utilizing stabilized zirconia ($ZrO_2$) containing lanthanum oxide ($La_2O_3$) therein as solid solution.

17. An oxide semiconductor for a thermistor made of a sintered mixture of metal oxides and useful as a temperature sensor in a middle temperature range of about 200° C. to at least 500° C., comprising 60.0–98.5 atomic % of manganese (Mn), 0.5–5.0 atomic % of nickel (Ni), 0.3–5.0 atomic % of chromium (Cr), 0.2–5.0 atomic % of ytterbium (Yb) and 0.5–28.0 atomic % of zirconium (Zr), to the sum total of 100 atomic %.

18. An oxide semiconductor for a thermistor in accordance with claim 17 wherein said oxide semiconductor for a thermistor is constituted by utilizing stabilized zirconia ($ZrO_2$) containing ytterbium oxide ($Yb_2O_3$) therein as solid solution.

19. An oxide semiconductor for a thermistor made of a sintered mixture of metal oxides and useful as a temperature sensor in a middle temperature range of about 200° C. to at least 500° C., comprising 60.05–98.5 atomic % of manganese (Mn), 0.1–5.0 atomic % of nickel (Ni), 0.3–5.0 atomic % of chromium (Cr), 0.2–5.0 atomic % of ytterbium (Yb) and 0.5–28.0 atomic % of zirconium (Zr), to the sum total of 100 atomic %—and which further contains silicon (Si) at a rate of 0.05–2.0 atomic % on the basis of the total amount of components exclusive of silicon (Si).

20. An oxide semiconductor for a thermistor in accordance with claim 19 wherein said oxide semiconductor for a thermistor is constituted by utilizing stabilized zirconia ($ZrO_2$) containing ytterbium oxide ($Yb_2O_3$) therein as solid solution.

* * * * *